US009908224B2

(12) United States Patent
Harmon

(10) Patent No.: US 9,908,224 B2
(45) Date of Patent: Mar. 6, 2018

(54) GLAND PULLER

(71) Applicant: John Harmon, Unionville, VA (US)

(72) Inventor: John Harmon, Unionville, VA (US)

( * ) Notice: Subject to any disclaimer, the term of this patent is extended or adjusted under 35 U.S.C. 154(b) by 13 days.

(21) Appl. No.: 14/986,591

(22) Filed: Dec. 31, 2015

(65) Prior Publication Data

US 2017/0190036 A1 Jul. 6, 2017

(51) Int. Cl.

| | |
|---|---|
| ***B25B 27/14*** | (2006.01) |
| ***B25B 27/00*** | (2006.01) |
| *F15B 15/14* | (2006.01) |

(52) U.S. Cl.

CPC ..... *B25B 27/14* (2013.01); *B25B 27/0028* (2013.01); *F15B 15/1433* (2013.01); *F15B 15/1461* (2013.01)

(58) Field of Classification Search

USPC ..... 29/235

See application file for complete search history.

(56) References Cited

U.S. PATENT DOCUMENTS

| | | | | |
|---|---|---|---|---|
| 218,871 A | | 8/1879 | Gillette | |
| 890,508 A | * | 6/1908 | Grohman | B25B 27/0028 81/8.1 |
| 1,030,732 A | | 6/1912 | Jenkins et al. | |
| 1,269,912 A | | 6/1918 | Dunham | |
| 1,442,626 A | * | 1/1923 | McGee | B25B 13/48 29/428 |
| 1,759,285 A | * | 5/1930 | Sease | B25B 27/06 29/275 |
| 2,098,134 A | | 11/1937 | Bennie et al. | |
| 2,424,681 A | | 7/1947 | Clem | |
| 2,568,998 A | | 9/1951 | Gill | |
| 3,083,449 A | * | 4/1963 | Simmons | B25B 27/02 29/255 |
| 3,270,407 A | | 9/1966 | Araujo | |
| 3,691,612 A | | 9/1972 | Layne | |
| 4,211,446 A | | 7/1980 | Shultz, Sr. | |
| 4,724,608 A | | 2/1988 | Parrott | |

(Continued)

FOREIGN PATENT DOCUMENTS

| | | | | |
|---|---|---|---|---|
| CH | 661465 A5 | * | 7/1987 | B25B 27/14 |
| DE | 4230237 | | 3/1994 | |

(Continued)

OTHER PUBLICATIONS

H1349, fig. 1-4; 26; col. 2, lines 63-68; col. 3, line 1-11, 24-36.

*Primary Examiner* — George Nguyen

(74) *Attorney, Agent, or Firm* — Christopher Paul Mitchell

(57) ABSTRACT

Gland puller for use in rebuilding hydraulic cylinders. Upon insertion of the first end of the elongated rod into a shaft hole of the hydraulic cylinder gland assembly beyond a first point, the rotating protrusion member is configured to rotate from the first position to the second position, and upon rotating the threaded collar along the threaded portion towards the first end, the elongated rod is configured to be pulled back from the first point to a second point where a surface of the at least one end of the rotating protrusion member is configured to abut an inner surface of the hydraulic cylinder gland assembly while a surface of the threaded collar is configured to abut an outer surface of the hydraulic cylinder gland.

20 Claims, 6 Drawing Sheets

(56) References Cited

U.S. PATENT DOCUMENTS

| | | | | |
|---|---|---|---|---|
| 4,982,523 | A * | 1/1991 | Garton | A01K 81/04 43/6 |
| 5,174,006 | A * | 12/1992 | Ellis | B25B 27/0028 29/275 |
| 5,408,733 | A | 4/1995 | Blankenship | |
| 6,035,946 | A * | 3/2000 | Studley | A62B 3/005 173/128 |
| 6,158,110 | A | 12/2000 | Takacs | |
| 6,442,817 | B1 * | 9/2002 | Swanson | B25B 27/06 29/275 |
| 6,877,198 | B2 | 4/2005 | Shevela | |
| 6,886,230 | B2 * | 5/2005 | Dagot | B25B 27/06 29/275 |
| 7,478,464 | B2 | 1/2009 | Kang | |
| 7,887,092 | B1 * | 2/2011 | Pacheco | A62B 3/005 280/727 |
| 9,566,698 | B2 * | 2/2017 | Huang | B25B 27/06 |
| 2010/0162858 | A1 | 7/2010 | Rogers | |
| 2014/0208558 | A1 * | 7/2014 | Gass | B25B 27/02 29/283 |
| 2017/0063014 | A1 * | 3/2017 | Rzasa | H01R 43/0428 |

FOREIGN PATENT DOCUMENTS

| | | |
|---|---|---|
| FR | 556018 | 7/1923 |
| GB | 494711 | 10/1938 |

* cited by examiner

GLAND PULLER

BACKGROUND

1. Field

Embodiments of the present invention relate generally to hydraulic cylinder rebuild tools. More particularly, embodiments of the present invention relate to a gland puller for use in rebuilding hydraulic cylinders.

2. Description of the Related Art

A hydraulic cylinder is a hydro-mechanical actuator capable of giving unidirectional force through a unidirectional stroke. Hydraulic cylinders are widely used in a variety of applications, including earth moving equipment. For example, a typical front-end loader of a tractor may use multiple hydraulic cylinders to lift a bucket of the loader.

FIG. 1 is a partial view of a disassembled exemplary hydraulic cylinder 100. The hydraulic cylinder 100 may include a barrel 102 that receives a rod 104 through a hole in a gland assembly 106. An inner end of the rod 104 may be attached to a piston 110 by a piston nut 108. When assembled, the outer end of the rod 104 may extend out of the barrel 102 through the gland assembly 106 and may be configured for attachment to an external device.

A first space within the barrel may exist between the piston and a bottom of the barrel and a second space may exist between the piston 110 and the gland assembly. The piston 110 may be movable within the barrel 102. Despite being movable, the piston fluidly seals the first space and the second space.

In operation, hydraulic fluid fills the first space within the barrel pushing the piston 110 towards the gland assembly 106 thereby decreasing the volume of space within the second space and causing the outer end of the rod 104 to extend further outward from the barrel 102 thereby moving the external device (e.g., lifting the bucket in the example of a front-end loader). The piston 110 is larger in diameter than the hole in the gland assembly 106 thereby preventing the rod 104 from coming out of the barrel 102. In other words, even if the first space within the barrel is completely filled with hydraulic fluid, and the volume of space within the second space is reduced to the point of being completely eliminated, the rod 104 will be prevented from coming out of the barrel 102 as a surface of the piston 110 will come into contact with and abut the inner surface of the gland assembly.

The gland assembly 106 may include a number of seals and rings (e.g., O-rings, rings, and snap rings). Of particular interest to the present disclosure is a snap ring that surrounds the gland assembly 106 and that is received within a groove extending around the inner surface of the barrel 102. When the gland assembly 106 is inserted into the barrel (initially, or after having been removed), the snap ring surrounds the gland assembly 106 and snaps into the groove extending around the inner surface of the barrel 102 thereby securing the gland assembly 106 in a predefined position within the barrel. When the gland assembly 106 reaches the predefined position within the barrel 102, the snap ring expands within the groove.

During the lifetime of the hydraulic cylinder 100, the gland assembly 106 may need to be removed. For example, the seals and rings of the gland assembly 106 may need to be replaced as a normal part of maintaining the hydraulic cylinder 100. To remove the gland assembly 106 using a normal removal procedure, force may be applied to an outer surface of the gland assembly 106 thereby pushing the gland assembly into the barrel 102 of the hydraulic cylinder 100. For example, a punch may be used to apply force to the outer surface of the gland assembly 106. By pushing the gland assembly 106 into the barrel 102, the snap ring is pushed up the side of the groove thereby compressing the snap ring enabling the gland assembly to travel beyond the predefined position within the barrel 102. After the gland assembly 106 is pushed a sufficient distance into the barrel 102, the groove extending around the inner surface of the barrel is exposed. A reverse chevron ring may be placed within the groove thereby filling the grove. The rod 104 may then be pulled outward from the barrel 102 such that the surface of the piston 110 will come into contact with and abut the inner surface of the gland assembly 106. The piston abutting the inner surface of the gland assembly 106 may cause the gland assembly to be pulled past the groove without the snap ring filling the groove due to the reverse chevron ring already filing the groove, and eventually out of the barrel 102. It should be noted that a sufficient amount of force is required in pulling the rod 104 such that the piston will cause the gland assembly 106 to travel past the groove even with the reverse chevron ring in place in the groove. That is, the gland assembly 106 does not simply slide out of the barrel 102 owing in part due to the tight fit necessary for the proper functioning of hydraulic cylinder within the hydraulic cylinder.

After prolonged use, the piston nut 108 may begin to loosen due to, e.g., temperature changes leading to expansion and contraction. When the piston nut loosens (e.g., rotates such that it loosens from being fully tightened against the piston 110), seals on the piston 110 begin to leak leading to degraded hydraulic performance. For example, on a front-end loader, the bucket of the loader may droop after being lifted indicating that seal is beginning to fail due to the piston nut 108 beginning to loosen.

Eventually, the piston nut 108 may become so loose that only a few threads are left engaged with the threads of the rod 104. At that point, pressure within the hydraulic cylinder 100 may cause the piston nut 108 to shear off the remaining threads and become completely disengaged from the rod 104 thereby disconnecting the inner end of the rod 104 from the piston 110. As the surface of the piston 110 can no longer come into contact with and abut the inner surface of the gland assembly 106, the rod 104 may then come out of the hole in the gland assembly 106 and become detached from the barrel 102.

Once the inner end of the rod 104 becomes disconnected from the piston 110, removal of the gland assembly 106 may become impossible using the normal removal procedure. While force may still be applied to an outer surface of the gland assembly 106 to push the gland assembly into the barrel, and while the reverse chevron ring may still be placed within the groove thereby filling the grove, there is no piston 110 attached to the rod 104 to come into contact with an abut the inner surface of the gland assembly 106. Thus, it is not possible to pull the rod such that the piston 110 will cause the gland assembly 106 to travel past the groove and eventually out of the barrel.

In light of the foregoing and other shortcomings in the art, it is desirable to provide a gland puller for use in rebuilding hydraulic cylinders.

BRIEF SUMMARY

It is an aspect of the invention to provide a gland puller for use in rebuilding hydraulic cylinders.

According to an aspect of the invention, a gland puller is provided. The gland puller comprises an elongated rod, a threaded collar, and a rotating protrusion member. The elongated rod includes a first end including a slot, a second end, and a threaded portion along a mid-surface of the elongated rod, the mid-surface being between the first end and the second end of the elongated rod. The threaded collar may be engaged to the threaded portion along the mid-surface of the elongated rod. The rotating protrusion member may be rotatably mounted within the slot at the first end of the elongated rod and may be configured to rotate between a first position and a second position. When the rotating protrusion member is in the first position, an axis of the rotating protrusion member is configured to align with an axis of the elongated rod and the rotating protrusion member is configured to be within a radius of the elongated rod. When the rotating protrusion member is in the second position, the axis of the rotating protrusion member is configured to be perpendicular to the axis of the elongated rod and one or more portions of the rotating protrusion member are configured to be outside of the radius of the elongated rod. Upon insertion of the first end of the elongated rod into a shaft hole of the hydraulic cylinder gland assembly beyond a first point, the rotating protrusion member is configured to rotate from the first position to the second position, and upon rotating the threaded collar along the threaded portion towards the first end, the elongated rod is configured to be pulled back from the first point to a second point where a surface of the at least one end of the rotating protrusion member is configured to abut an inner surface of the hydraulic cylinder gland assembly while a surface of the threaded collar is configured to abut an outer surface of the hydraulic cylinder gland.

The foregoing and other aspects and embodiments will become apparent from the following detailed description when considered in conjunction with the accompanying drawing figures.

DESCRIPTION

Figure 1:
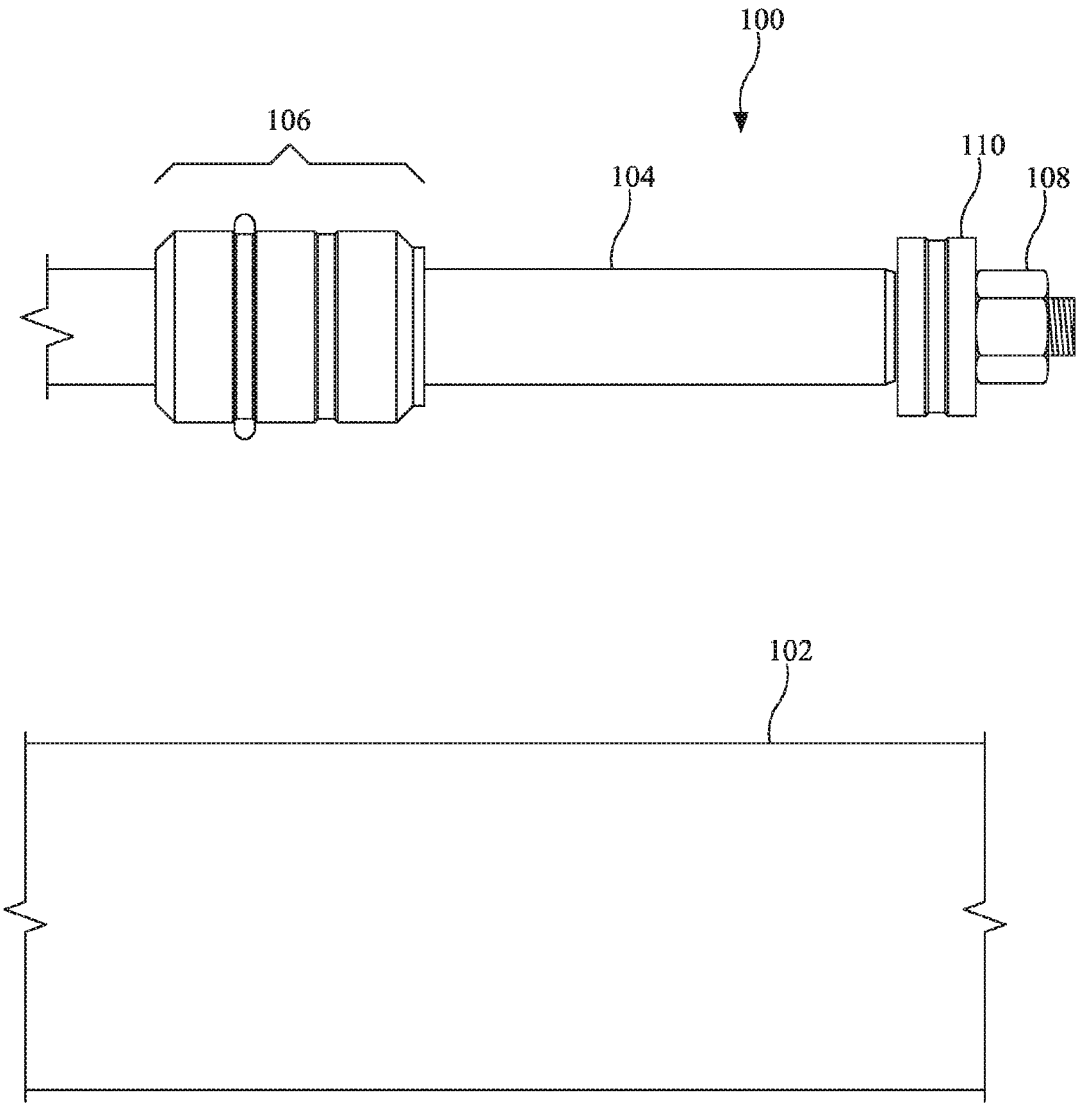
FIG. 1 (Background Art)
FIG. 1 is a cut way of an exemplary hydraulic cylinder.

Reference will now be made in detail to embodiments of the present invention, examples of which are illustrated in the accompanying drawings, wherein like reference numerals refer to the like elements throughout. The embodiments are described below to explain the present invention by referring to the figures.

As used in the description of this application, the terms "a", "an" and "the" may refer to one or more than one of an element (e.g., item or act). Similarly, a particular quantity of an element may be described or shown while the actual quantity of the element may differ. The terms "and" and "or" may be used in the conjunctive or disjunctive sense and will generally be understood to be equivalent to "and/or". Elements from an embodiment may be combined with elements of another. No element used in the description of this application should be construed as critical or essential to the invention unless explicitly described as such. Further, when an element is described as "connected," "coupled," or otherwise linked to another element, it may be directly linked to the other element, or intervening elements may be present.

According to an exemplary embodiment, a gland puller for use in rebuilding hydraulic cylinders may be provided. The gland puller may include an elongated rod, a threaded collar, and a protrusion member such as a rotating block. The elongated rod may include a first end including a housing such as a slot housing the rotating block. The threaded collar may be engaged to a threaded portion of the elongated rod. Upon insertion of the first end of the elongated rod into a shaft hole of a hydraulic cylinder gland assembly beyond a first point, the rotating block may rotate from a first position to a second position, and upon rotating the threaded collar along the threaded portion towards the first end, the elongated rod may be pulled back from the first point to a second point where a surface of the at least one end of the rotating block abuts an inner surface of the hydraulic cylinder gland assembly while a surface of the threaded collar abuts an outer surface of the hydraulic cylinder gland.

Figure 2:
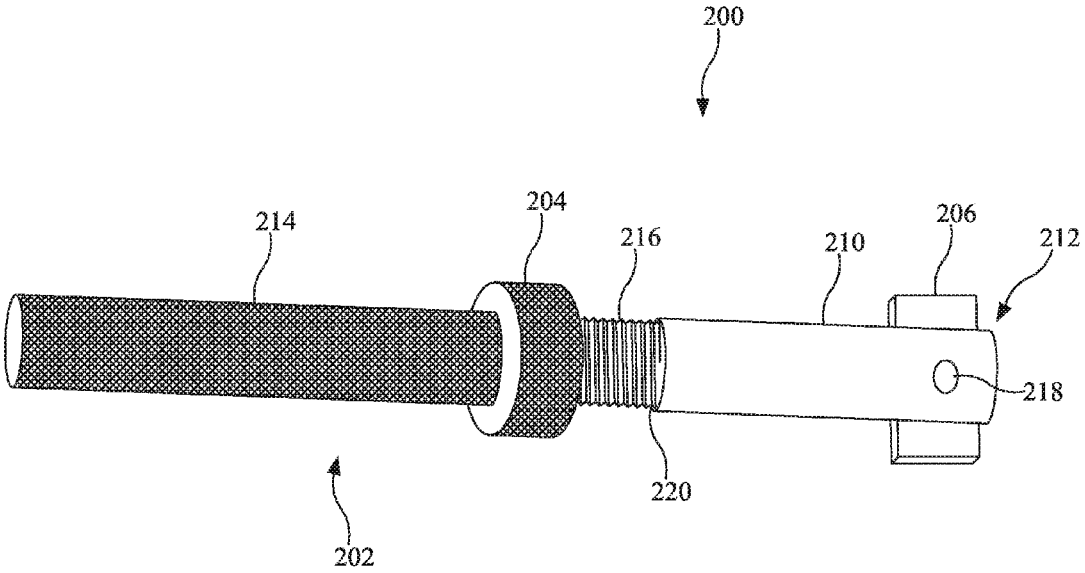
FIG. 2 is a perspective view of a gland puller according to an exemplary embodiment of the present invention.
Figure 3:
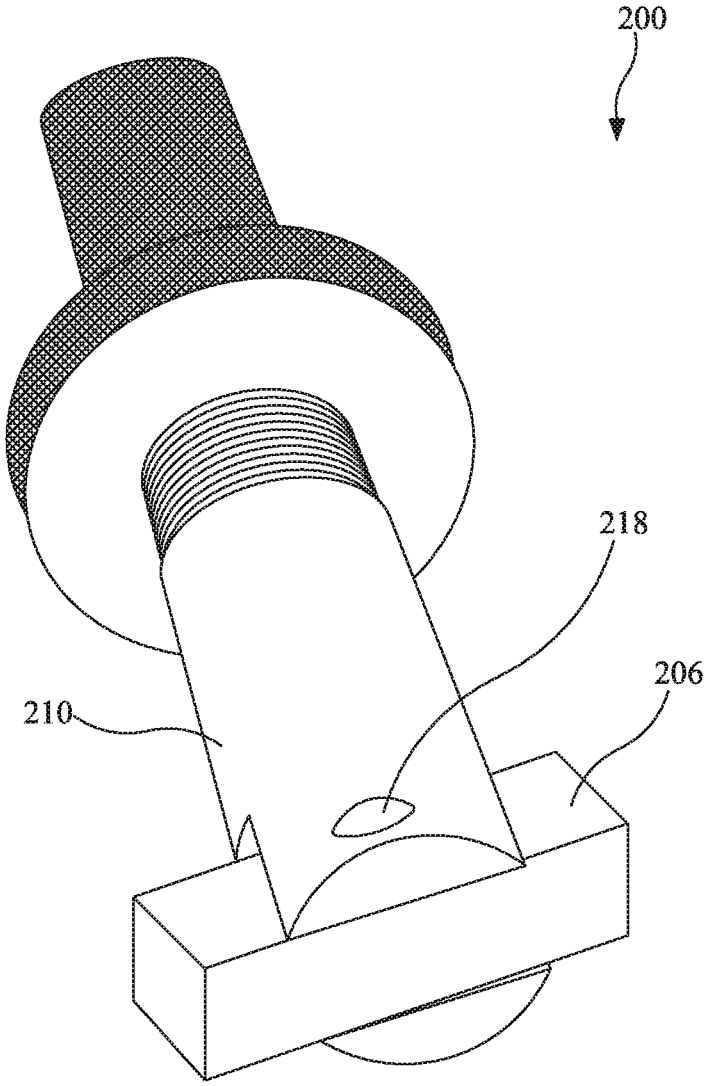
FIG. 3 is a bottom view of the gland puller of FIG. 2.
Figure 4:
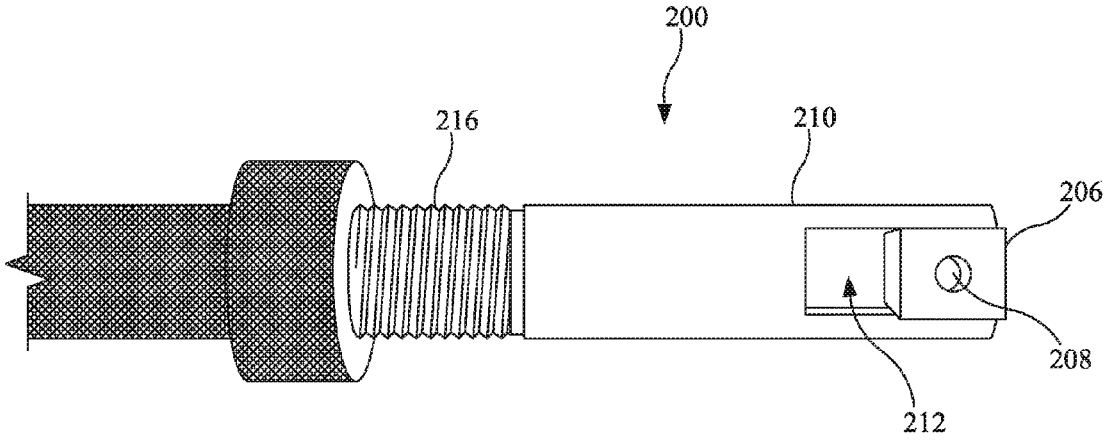
FIG. 4 is a side view of a portion of the gland puller of FIG. 2.

FIG. 2 is a perspective view of a gland puller 200 according to an exemplary embodiment of the present invention. FIG. 3 is a bottom view of the gland puller 200 of FIG. 2. FIG. 4 is a side view of the gland puller 200 of FIG. 2. The gland puller 200 may include an elongated rod 202, a threaded collar 204, and a protrusion member 206.

The elongated rod 202 may include a first end 210 including a housing 212 such as a slot, a second end 214, and a threaded portion 216 along a mid-surface of the elongated rod 202. The elongated rod 202 may be of a sufficient length and diameter to be engageable to a gland assembly as discussed herein and to provide a handle for a user to grip in removing a gland assembly from a barrel of a hydraulic cylinder. One of ordinary skill in the art will appreciate that the dimensions of the elongated rod and the dimensions of the remaining elements herein are variable so as to be configured for different size hydraulic cylinders. For example, in the embodiment shown in FIGS. 2-6B, the elongated rod may be approximately 9.9 inches long, and have a diameter of approximately 1.2 inches. Alternative embodiments are contemplated and are considered to be within the scope of the present invention. For example, a larger elongated rod may be provided for use with larger hydraulic cylinders and a smaller elongated rod may be provided for use with smaller hydraulic cylinders. The elongated rod 202 (and the threaded collar 204 and the protrusion member 206) may be formed from steel. In an embodiment, the elongated rod (and/or other elements) may be treated such as by applying a black oxide coating. Alternative materials are contemplated and are considered to be within the scope of the present invention. For example, alternative metals such as aluminum, or other non-metal may be used. However, it is noted that steel provides a desirable strength and weight for this particular application.

The first end 210 of the elongated rod 202 may be cylindrical in shape so as to be insertable into a shaft hole of a hydraulic cylinder gland. For example, in the embodiment shown, the first end 210 may have a diameter of 1.2 inches. The first end 210 may include a housing 212 such as a slot. The housing 212 may be defined by two side portions and may be configured to receive the protrusion member 206. The first end 210 may be approximately 2.8 inches in length. The housing 212 may be approximately 0.6 inches wide and approximately 1.4 inches deep. As noted above, alternative dimensions and configurations may be appropriate.

The second end 214 of the elongated rod 202 may be cylindrical in shape. The second end 214 may have a knurled surface and may serve as a handle. The knurled surface may provide increased grip for a user. The second end may be approximately 5.3 inches long. Alternative embodiments are contemplated and are considered to be within the scope of the present invention. For example, a neoprene or rubber covered cylindrical handle may be provided. As noted above, alternative dimensions may be appropriate.

The threaded portion 216 along the mid-surface of the elongated rod 202 may be of a width so as to enable a position of a threaded collar 204 to be rotatably adjustable over a distance from an unengaged position to an engaged position. For example, the threaded portion 216 may be approximately 1.6 inches wide. The treaded portion 216 may have threads corresponding to threads of the threaded collars 204. For example, the threaded portion 216 may include 1¼ inch threads. Alternative embodiments are contemplated and are considered to be within the scope of the present invention. For example, the threaded portion may narrower or wider, and may even extend along the entire length of the elongated rod. In an embodiment, grooves 220 of approximately 0.1 inches each may be provided between the first end 210 and the threaded portion 216 and between the second end 214 and the threaded portion 216.

The threaded collar 204 of the gland puller 200 may be engaged to the threaded portion 216 along the mid-surface of the elongated rod 202. The treaded collar 204 may have threads corresponding to threads of the threaded portion 216. For example, the threaded collar 204 may include 1¼ inch threads. The threaded collar 204 may have a knurled surface that may provide increased grip for a user. The threaded collar 204 may have an outer diameter larger than a diameter of a shaft hole of a hydraulic cylinder gland, and an inner (hole) diameter corresponding to a diameter of the threaded portion 216 along the mid-surface of the elongated rod 202. For example, the threaded collar 204 may have an outer diameter of approximately 2.1 inches and an inner diameter of approximately 1.2 inches. In an embodiment, the threaded collar 204 may be 0.8 inches deep. Alternative embodiments are contemplated and are considered to be within the scope of the present invention. For example, a larger threaded collar may be provided for use with larger hydraulic cylinders and a smaller threaded collar may be provided for use with smaller hydraulic cylinders as noted above. The threaded collar may be formed from steel as discussed above.

As noted above, the threaded collar 204 may be rotatably adjustable over a distance from an unengaged position to an engaged position by rotating the threaded collar along the threaded portion 216 towards the first end 210.

The protrusion member 206 may be mounted within the housing 212 at the first end 210 of the elongated rod 202. In an embodiment, the protrusion member 206 may be a rotating protruding member such as a rotating block. The protrusion member 206 may be configured to move from a first position to a second position. For example, in the rotating protruding member embodiment, the rotating block may rotate between a first position and a second position. The rotating block may be rotatably mounted within the slot 212 by a pin 218. The rotating block may include a hole in one side. Accordingly, the side of the rotating block not having the hole may be heavier and thus may rotate downward around the pin due to gravity.

In an alternative embodiment, a removable screw or bolt may be used instead of a pin thereby providing a user with a convenient method for removing the rotating protrusion member 206 so as to attach differently-dimensioned rotating protrusion members for different applications (i.e., different hydraulic cylinders). The differently-dimensioned rotating protrusion members may be used in conjunction with various bushings to surround the first end so as to provide different effective diameters of the first end 210 of the elongated rod 202 for use with the different applications. Similarly, differently-dimensioned threaded-collars may be provided. Accordingly, one gland puller may be used for a range of differently-dimensioned hydraulic cylinders.

Figure 6A:
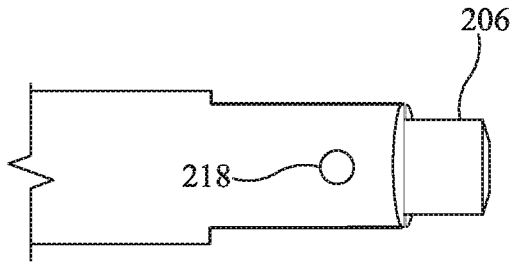
FIGS. 6A and 6B are schematic representations of a portion of the gland puller 200 of FIG. 2.
Figure 6B:
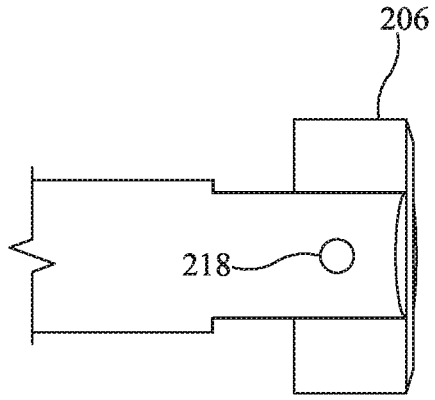

When the rotating protrusion member 206 is in the first position, an axis of the rotating protrusion member 206 is configured to align with an axis of the elongated rod 202. This alignment of the axis of the rotating protrusion member 206 with the axis of the elongated rod 202 is shown in FIG. 6A. When the rotating protrusion member 206 is in the first position, the rotating protrusion member 206 is configured to be within a radius of the elongated rod 202. When the rotating protrusion member 206 is in the second position, the axis of the rotating protrusion member 206 is configured to be perpendicular to the axis of the elongated rod 202. This perpendicular arrangement of the axis of the rotating protrusion member 206 relative to the axis of the elongated rod 202 is shown in FIG. 6B. When the rotating protrusion member 206 is in the second position, one or more portions of the rotating protrusion member 206 are configured to be outside of the radius of the elongated rod 202. Alternative embodiments are contemplated and considered to be within the scope of the present invention. For example, a rotating protrusion member may rotate around a pin off-centered that may provide only one portion outside of the radius of the elongated rod 202. Further, a protrusion member 206 including one or more spring-mounted jaw members may be provided. For example, two "L" shaped members may be provided with one or more springs that push the L shaped members into a position where a portion of each of the of L shaped members extends outside the radius of the elongated rod. These spring-mounted jaw members may be squeezed together for insertion into a hole of a gland assembly and then may be extend into the position where the portion of each of the spring-mounted jaw members extends outside the radius of the elongated rod after being pushed through the hole of the gland assembly, after which a threaded collar may be tightened.

Figure 5:
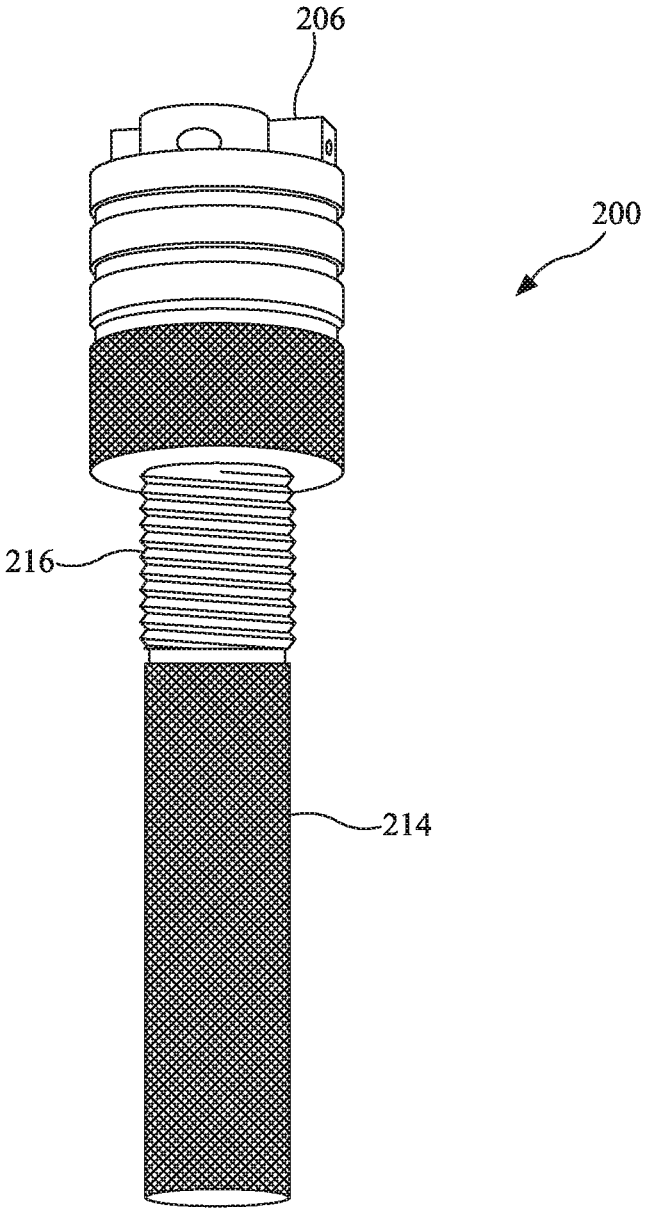
FIG. 5 is a perspective view of the gland puller of FIG. 2 engaged to a gland assembly.

The operation of the gland puller 200 is now described with respect to FIGS. 5, 6A, and 6B. FIG. 5 is a perspective view of the gland puller of FIG. 2 engaged to a gland assembly. FIGS. 6A and 6B are schematic representations of a portion of the gland puller 200 of FIG. 2.

In operation, a user may be presented with a hydraulic cylinder that has suffered a catastrophic failure. That is, the inner end of the rod has become disconnected from the piston of the hydraulic cylinder due to removal of failure of the piston nut. Accordingly, a gland assembly of the hydraulic cylinder may be effective stuck within the barrel.

The user may verify that the threaded collar 204 of the gland puller 200 is rotated away from the first end 210 of the elongated rod 202, and that the rotating protrusion member 206 is in first position (axis of the rotating protrusion member aligned with an axis of the elongated rod, rotating protrusion member within a radius of the elongated rod). The user may insert the first end 210 of the elongated rod 202 into and through a shaft hole of a gland assembly. Upon insertion of the first end of the elongated rod into the shaft hole of the hydraulic cylinder gland assembly beyond a first point, the rotating protrusion member may rotate from the first position to the second position (axis of the rotating protrusion member perpendicular to the axis of the elongated rod, one or more portions of the rotating protrusion member outside of the radius of the elongated rod). The rotating protrusion member may rotate due to gravity pulling the heavier side of the rotating protrusion member (i.e., the end of the rotating block not having a hole 208 in it) downward. The user may then rotate the threaded collar along the threaded portion 216 towards the first end causing the elongated rod 202 to be pulled back from the first point to a second point where a surface of at least one end of the rotating protrusion member 206 abuts an inner surface of the hydraulic cylinder gland assembly while a surface of the threaded collar 204 abuts an outer surface of the hydraulic cylinder gland. At this point, the gland puller 200 may be engaged to the gland assembly.

The user may then apply force to the gland puller 200 (e.g., by applying force to the second end 214) towards the barrel thereby contracting the snap ring of the gland assembly and pushing the gland assembly into the barrel to a point where the groove of the barrel is accessible. Because force is applied to the gland puller and then to the gland assembly by the threaded collar (abutting the gland assembly), the outer surface of the gland assembly is not damaged, nor are the various components (e.g., seals) of the gland assembly. The user may then insert a reverse chevron ring within the grove of the barrel and then pull the gland puller 200 outward with sufficient force to pull the gland assembly past the groove with the reverse chevron ring in place and out of the barrel of the hydraulic cylinder, thus concluding the operation of the gland puller 200.

It should be noted that the gland puller 200 may be manufactured according to appropriate manufacturing methods. For example, an elongated rod may be milled or cast to include a first end including a slot, a second end, and a threaded portion along a mid-surface of the elongated rod, the mid-surface being between the first end and the second end of the elongated rod. A threaded collar may be milled or cast so as to be configured to be engaged to the threaded portion along the mid-surface of the elongated rod. A rotating protrusion member may be milled or cast so as to be configured to be rotatably mounted within the slot at the first end of the elongated rod, the rotating protrusion member configured to rotate between a first position and a second position. The threaded collar may be engaged to the threaded portion along the mid-surface of the elongated rod. The rotating protrusion member may be rotatably mounted within the slot using a pin or screw.

Embodiments of the present invention provide for a gland puller for use in rebuilding hydraulic cylinders. Embodiments of the present invention may provide for a number of benefits, including a tool that enables removal of a gland assembly from a hydraulic cylinder after the piston of the hydraulic cylinder becomes disconnected from a rod due to removal or failure of a piston nut within the hydraulic cylinder. The gland puller may be easy for a user to use, and may be configurable for a range of differently-dimensioned hydraulic cylinders.

The foregoing description discloses only exemplary embodiments of the invention. Modifications of the above-disclosed embodiments of the present invention (beyond those modifications already mentioned) of which fall within the scope of the invention will be readily apparent to those of ordinary skill in the art. For instance, although in some embodiments, a threaded collar is described as being engaged to a threaded portion of an elongated rod, one or more pins may be provided with corresponding pin holes in the elongated rod. As another example, although a knurled cylindrical second end is described as a handle, an alternative handle such as a hand-shaped handle or a D shaped second end may be provided.

Accordingly, although embodiments of the present invention have been shown and described, it would be appreciated by those skilled in the art that changes may be made in these embodiments without departing from the principles and spirit of the invention.

The invention claimed is:

1. A gland puller, comprising:

an elongated rod, including:

a first end including a housing; and a threaded portion along a mid-surface of the elongated rod, the mid-surface being between the first end and a handle of the elongated rod;

a threaded collar engaged to the threaded portion along the mid-surface of the elongated rod; and a protrusion member mounted within the housing at the first end of the elongated rod, the protrusion member configured to move from a first position and a second position, wherein, when the protrusion member is in the first position, the protrusion member is configured to be within a radius of the elongated rod, and wherein, when the protrusion member is in the second position, one or more portions of the protrusion member are configured to be outside of the radius of the elongated rod.

2. The gland puller of claim 1, wherein upon insertion of the first end of the elongated rod into a shaft hole of a hydraulic cylinder gland assembly beyond a first point, the protrusion member is configured to move from the first position to the second position, and upon rotating the threaded collar along the threaded portion towards the first end, the elongated rod is configured to be pulled back from the first point to a second point where a surface of the at least one portion of the protrusion member is configured to abut an inner surface of the hydraulic cylinder gland assembly while a surface of the threaded collar is configured to abut an outer surface of the hydraulic cylinder gland assembly.

3. The gland puller of claim 1, wherein the elongated rod further includes a second end, and wherein the second end constitutes the handle.

4. The gland puller of claim 3, wherein the second end comprises a knurled surface.

5. The gland puller of claim 1, wherein the threaded collar comprises a knurled surface.

6. The gland puller of claim 1, wherein the housing of the first end comprises a slot, and wherein the protrusion member comprises a rotating protrusion member rotatably mounted within the slot, the rotating protrusion member configured to rotate between the first position and the second position.

7. The gland puller of claim 6, wherein the rotating protrusion member comprises a rotating block.

8. The gland puller of claim 7, wherein the rotating block comprises a hole in one side.

9. The gland puller of claim 6, wherein the rotating protrusion member is connected to the slot by a pin or screw extending through the elongated rod and the rotating protrusion member.

10. The gland puller of claim 9, wherein the pin or screw extends through a center of the rotating protrusion member and whereby both ends of the rotating protrusion member constitute the one or more portions of the protrusion member configured to be outside the radius of the elongated rod.

11. The gland puller of claim 1, wherein the protrusion member comprises one or more spring mounted jaw members mounted within the housing, the one or more spring mounted jaw members configured to move from the first position to the second position by a spring.

12. A gland puller, comprising:

an elongated rod, including:

a first end including a slot;

a second end; and a threaded portion along a mid-surface of the elongated rod, the mid-surface being between the first end and the second end of the elongated rod;

a threaded collar engaged to the threaded portion along the mid-surface of the elongated rod; and a rotating protrusion member rotatably mounted within the slot at the first end of the elongated rod, the rotating protrusion member configured to rotate between a first position and a second position, wherein, when the rotating protrusion member is in the first position, an axis of the rotating protrusion member is configured to align with an axis of the elongated rod and the rotating protrusion member is configured to be within a radius of the elongated rod, wherein, when the rotating protrusion member is in the second position, the axis of the rotating protrusion member is configured to be perpendicular to the axis of the elongated rod and one or more portions of the rotating protrusion member are configured to be outside of the radius of the elongated rod, and wherein upon insertion of the first end of the elongated rod into a shaft hole of a hydraulic cylinder gland assembly beyond a first point, the rotating protrusion member is configured to rotate from the first position to the second position, and upon rotating the threaded collar along the threaded portion towards the first end, the elongated rod is configured to be pulled back from the first point to a second point where a surface of the at least one end of the rotating protrusion member is configured to abut an inner surface of the hydraulic cylinder gland assembly while a surface of the threaded collar is configured to abut an outer surface of the hydraulic cylinder gland assembly.

13. The gland puller of claim 12, wherein the second end comprises a knurled surface.

14. The gland puller of claim 12, wherein the threaded collar comprises a knurled surface.

15. The gland puller of claim 12, wherein the rotating protrusion member is connected to the slot by a pin or screw extending through the elongated rod and the rotating protrusion member.

16. The gland puller of claim 13, wherein the pin extends through a center of the rotating protrusion member and whereby both ends of the rotating protrusion member constitute the one or more portions of the rotating protrusion member configured to be outside the radius of the elongated rod.

17. The gland puller of claim 16, wherein the rotating protrusion member comprises a rotating block, and wherein the rotating block comprises a hole in one end.

18. A method of manufacturing a gland puller, comprising the steps of:

milling or casting an elongated rod to include:

a first end including a slot;

a second end; and a threaded portion along a mid-surface of the elongated rod, the mid-surface being between the first end and the second end of the elongated rod;

milling or casting a threaded collar configured to be engaged to the threaded portion along the mid-surface of the elongated rod; and milling or casting a rotating protrusion member configured to be rotatably mounted within the slot at the first end of the elongated rod, the rotating protrusion member configured to rotate between a first position and a second position.

19. The method of manufacturing a gland puller of claim 18, further comprising the steps of:

engaging the threaded collar to the threaded portion along the mid-surface of the elongated rod.

20. The method of manufacturing a gland puller of claim 18, further comprising the steps of:

rotatably mounting the rotating protrusion member within the slot using a pin or screw.

* * * * *